US010173254B2

(12) United States Patent
Ueno et al.

(10) Patent No.: US 10,173,254 B2
(45) Date of Patent: Jan. 8, 2019

(54) MOLDING APPARATUS

(71) Applicant: SUMITOMO HEAVY INDUSTRIES, LTD., Tokyo (JP)

(72) Inventors: Norieda Ueno, Tokyo (JP); Masayuki Ishizuka, Niihama (JP); Masayuki Saika, Niihama (JP); Takashi Komatsu, Oyama (JP)

(73) Assignee: Sumitomo Heavy Industries, Ltd., Tokyo (JP)

( * ) Notice: Subject to any disclaimer, the term of this patent is extended or adjusted under 35 U.S.C. 154(b) by 0 days.

(21) Appl. No.: 15/175,264

(22) Filed: Jun. 7, 2016

(65) Prior Publication Data

US 2016/0279693 A1 Sep. 29, 2016

Related U.S. Application Data

(63) Continuation of application No. PCT/JP2014/076098, filed on Sep. 30, 2014.

(30) Foreign Application Priority Data

Dec. 9, 2013 (JP) ..... 2013-254383

(51) Int. Cl.
*B21D 26/035* (2011.01)
*B21D 26/047* (2011.01)

(52) U.S. Cl.
CPC ..... *B21D 26/035* (2013.01); *B21D 26/047* (2013.01)

(58) Field of Classification Search
CPC .. B21D 26/033; B21D 26/035; B21D 26/039; B21D 26/047; B21D 26/045;
(Continued)

(56) References Cited

U.S. PATENT DOCUMENTS 3,380,282 A * 4/1968 Scaletta ..... B21D 51/383 413/14
5,070,717 A 12/1991 Boyd et al.
(Continued)

FOREIGN PATENT DOCUMENTS

JP S62282728 A 12/1987
JP H0542338 A 2/1993
(Continued)

OTHER PUBLICATIONS

JPO Machine Translation to English for JP 2012000654 A.*
(Continued)

*Primary Examiner* — Pradeep C Battula
(74) *Attorney, Agent, or Firm* — Squire Patton Boggs (US) LLP

(57) ABSTRACT

A molding apparatus that molds a metal pipe with a flange is disclosed. The molding apparatus includes a first mold and a second mold that are paired with each other, a slide that moves at least one of the first mold and the second mold, a drive unit that generates a driving force for moving the slid, a holding section that holds a metal pipe material between the first mold and the second mold, a gas supply section that supplies gas into the metal pipe material held by the holding section, and a control unit that controls the drive unit, the holding section, and the gas supply section. The first mold and the second mold are provided with a first cavity portion that molds a pipe portion of the metal pipe, and a second cavity portion that molds a flange portion.

2 Claims, 9 Drawing Sheets

(58) Field of Classification Search
CPC ..... B21D 26/051; B21D 51/06; B21D 19/08; B21D 19/00
See application file for complete search history.

(56) References Cited

U.S. PATENT DOCUMENTS

| | | | | |
|---|---|---|---|---|
| 6,263,720 | B1 * | 7/2001 | Valin | B21D 53/88 72/370.1 |
| 6,739,166 | B1 * | 5/2004 | Shah | B21D 26/033 29/421.1 |
| 8,171,769 | B2 * | 5/2012 | Barthelemy | B21D 26/033 72/370.22 |
| 2012/0047979 | A1 * | 3/2012 | Hertell | B21D 26/033 72/58 |

FOREIGN PATENT DOCUMENTS

| | | | |
|---|---|---|---|
| JP | 2001507283 | A | 6/2001 |
| JP | 2001-259754 | A | 9/2001 |
| JP | 2003154415 | A | 5/2003 |
| JP | 2003523286 | A | 8/2003 |
| JP | 2004268068 | A | 9/2004 |
| JP | 2005207710 | A | 8/2005 |
| JP | 2006122979 | A | 5/2006 |
| JP | 2009220141 | A | 10/2009 |
| JP | 2012000654 | A | 1/2012 |
| WO | 2005/051562 | A1 | 6/2005 |

OTHER PUBLICATIONS

International Search Report application No. PCT/JP2014/076098 dated Dec. 22, 2014.
International Search Report Written Opinion application No. PCT/JP2014/076098 dated Jun. 23, 2016.
Supplemental European Search Report issued in corresponding European Patent Application No. 14870135.2 dated Jul. 7, 2017.
Japanese Office Action application No. 2013-254383 dated Apr. 10, 2018.

* cited by examiner

MOLDING APPARATUS

RELATED APPLICATIONS

Priority is claimed to Japanese Patent Application No. 2013-254383, filed Dec. 9, 2013, and International Patent Application No. PCT/JP2014/076098, the entire content of each of which is incorporated herein by reference.

BACKGROUND

Technical Field

Certain embodiments of the present invention relate to a molding apparatus which molds a metal pipe with a flange.

Description of Related Art

In the related art, a molding apparatus is known which performs molding by expanding a heated metal pipe material by supplying gas into the heated metal pipe material. For example, a molding apparatus according to the related art is provided with an upper mold and a lower mold which are paired with each other, a holding section which holds a metal pipe material between the upper mold and the lower mold, and a gas supply section which supplies gas into the metal pipe material held by the holding section. In this molding apparatus, it is possible to mold the metal pipe material into a shape corresponding to the shape of a mold by expanding the metal pipe material by supplying gas into the metal pipe material in a state of being held between the upper mold and the lower mold.

SUMMARY

According to an embodiment of the present invention, there is provided a molding apparatus that molds a metal pipe with a flange, including: a first mold and a second mold that are paired with each other; a slide that moves at least one of the first mold and the second mold; a drive unit that generates a driving force for moving the slide; a holding section that holds a metal pipe material between the first mold and the second mold; a gas supply section that supplies gas into the metal pipe material held by the holding section; and a control unit that controls the drive unit, the holding section, and the gas supply section, in which the first mold and the second mold are provided with a first cavity portion that molds a pipe portion of the metal pipe, and a second cavity portion that molds a flange portion, the control unit controls the gas supply section such that the gas supply section expands and molds the metal pipe material by supplying gas into the metal pipe material held between the first mold and the second mold by the holding section and controls the drive unit such that the drive unit molds the flange portion by crushing a portion of the expanded metal pipe material in the second cavity portion of the first mold and the second mold, and the second cavity portion communicates with the outside of the molds during molding of the flange portion.

BRIEF DESCRIPTION OF THE DRAWINGS

FIGS. 3A and 3B are diagrams showing a manufacturing process of the molding apparatus, in which FIG. 3A is a diagram showing a state where a metal pipe material has been placed into a mold and FIG. 3B is a diagram showing a state where the metal pipe material is held by electrodes.

FIGS. 5A to 5C are enlarged views of the surroundings of the electrode, in which FIG. 5A is a diagram showing a state where the electrode holds the metal, pipe material, FIG. 5B is a diagram showing a state where a blowing mechanism is in contact with the electrode, and FIG. 5C is a front view of the electrode.

FIGS. 6A to 6C are diagrams showing an operation of the blow molding mold and a change in the shape of the metal pipe material, in which FIG. 6A is a diagram showing a state at the point in time when the metal pipe material is set in the blow molding mold, FIG. 6B is a diagram showing a state during blow molding, and FIG. 6C is a diagram showing a state where a flange portion has been molded by pressing.

FIGS. 7A to 7C are diagrams showing an operation of a blow molding mold according to a modification example and a change in the shape of the metal pipe material, in which FIG. 7A is a diagram showing a state at the point in time when the metal pipe material is set in the blow molding mold, FIG. 7B is a diagram showing a state during blow molding, and FIG. 7C is a diagram showing a state where a flange portion has been molded by pressing.

FIGS. 8A to 8C are diagrams showing an operation of a blow molding mold according to a modification example and a change in the shape of the metal pipe material, in which FIG. 8A is a diagram showing a state at the point in time when the metal pipe material is set in the blow molding mold, FIG. 8B is a diagram showing a state during blow molding, and FIG. 8C is a diagram showing a state where a flange portion has been molded by pressing.

FIGS. 9A to 9C are diagrams showing an operation of a blow molding mold according to a comparative example and a change in the shape of the metal pipe material, in which FIG. 9A is a diagram showing a state at the point in time when the metal pipe material is set in the blow molding mold, FIG. 9B is a diagram showing a state during blow molding, and FIG. 9C is a diagram showing a state where a flange portion has been molded by pressing.

DETAILED DESCRIPTION

Figure 1:
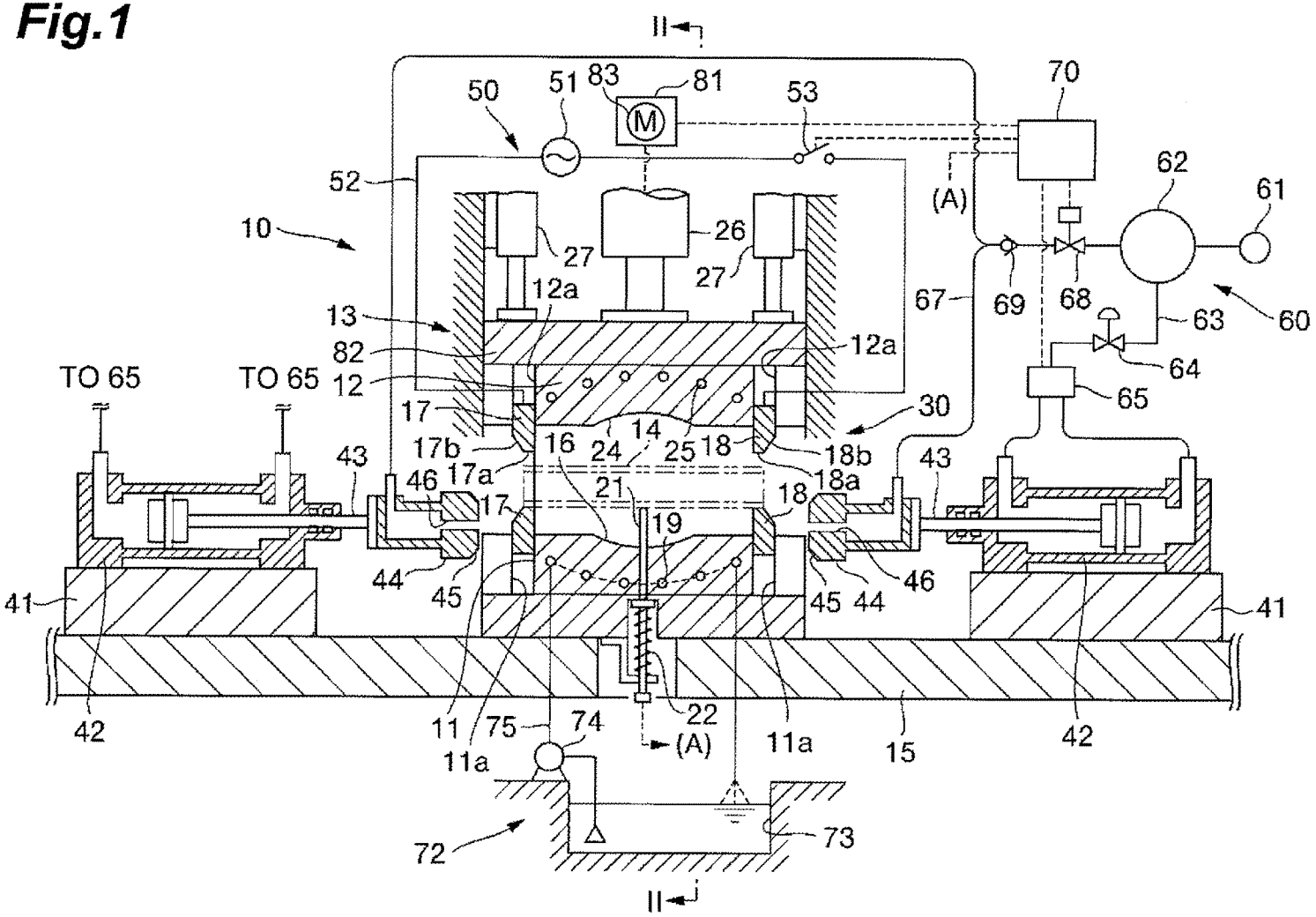
FIG. 1 is a schematic configuration diagram of a molding apparatus according to an embodiment of the present invention.

Here, there has been a demand for molding a flange on a metal pipe. In a case where a metal pipe with a flange is molded by the molding apparatus as described above, a cavity for flange molding having a small volume is formed in a mold, a metal pipe is expanded and molded, and a flange can be molded by crushing a portion of the metal pipe material in the cavity for flange molding. In such a case, in a case where the cavity of the mold is a space closed with respect to the outside of the mold, at the time of the molding of the flange, air is accumulated between the inner surface of the mold and a portion which becomes the flange, and thus there is a possibility that it may cause an influence on the quality of a molding product, such as the occurrence of wrinkles.

It is desirable to provide a molding apparatus which can improve the quality of a molding product.

In the molding apparatus according to the above aspect of the present invention, the control unit controls the gas supply section such that the gas supply section expands and molds the metal pipe material by supplying gas into the metal pipe material held between the first mold and the second mold by the holding section. In this way, a portion corresponding to the pipe portion, of the metal pipe material, is expanded and molded into a shape corresponding to the first cavity portion, and a portion corresponding to the flange portion expands toward the second cavity portion. Further, the control unit controls the drive unit such that the drive unit molds the flange portion by crushing a portion of the expanded metal pipe material in the second cavity portion between the first mold and the second mold. Here, the second cavity portion communicates with the outside of the molds during the molding of the flange portion. Therefore, during the molding of the flange portion, air between the inner surface of the second cavity portion and a place forming the flange portion of the metal pipe material can escape to the outside of the mold. In this way, it is possible to prevent the occurrence of wrinkles, or the like, and thus the quality of a molding product can be improved.

Further, in the molding apparatus according to the above aspect of the present invention, the second cavity portion may communicate with the outside of the mold from the start of molding to the completion of molding. In this way, air in the second cavity portion can escapes to the outside of the mold from the start of molding to the completion of molding, and therefore, the quality of a molding product can be improved.

Further, in the molding apparatus according to the above aspect of the present invention, a step having a size corresponding to a thickness of the flange portion may be formed in at least one of the first mold and the second mold in the second cavity portion. In this way, at the point in time when the second cavity portion has molded the flange portion, crushing of the flange portion by the second cavity portion is restricted by the step having a size corresponding to the thickness of the flange portion. Therefore, the flange portion can be prevented from being crushed more than necessary.

<Configuration of Molding Apparatus>

As shown in FIG. 1, a molding apparatus 10 which molds a metal pipe with a flange is configured to include: a blow molding mold 13 which is composed of an upper mold (a first mold) 12 and a lower mold (a second mold) 11; a slide 82 which moves at least one of the upper mold 12 and the lower mold 11; a drive unit 81 which generates a driving force for moving the slide 82; a pipe holding mechanism (a holding section) 30 which horizontally holds a metal pipe material 14 between the upper mold 12 and the lower mold 11; a heating mechanism 50 which energizes and heats the metal pipe material 14 held by the pipe holding mechanism 30; a blowing mechanism (a gas supply section) 60 which blows high-pressure gas into the heated metal pipe material 14; a control unit 70 which controls the drive unit 81, the pipe holding mechanism 30, the heating mechanism 50, and the blowing mechanism 60; and a water circulation mechanism 72 which forcibly water-cools the blow molding mold 13. The control unit 70 performs a series of control such as closing the blow molding mold 13 when the metal pipe material 14 has been heated to a quenching temperature (a temperature higher than or equal to an AC3 transformation point temperature) and blowing high-pressure gas into the heated metal pipe material 14. In addition, in the following description, a pipe related to a finished product is referred to as a metal pipe 80 (refer to FIG. 4), and a pipe in a stage on the way to lead to completion is referred to as the metal pipe material 14.

Figure 5A:
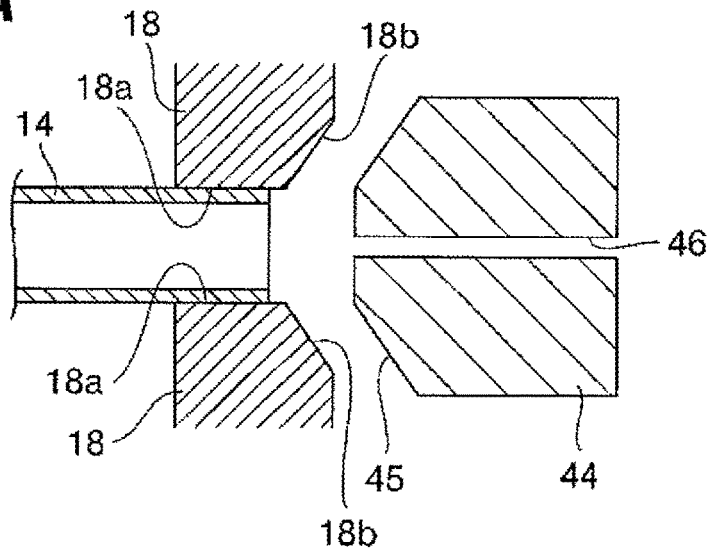
Figure 5B:
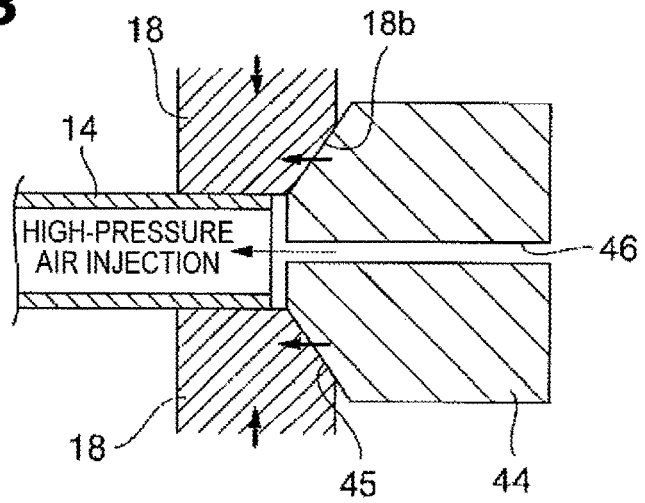
Figure 5C:
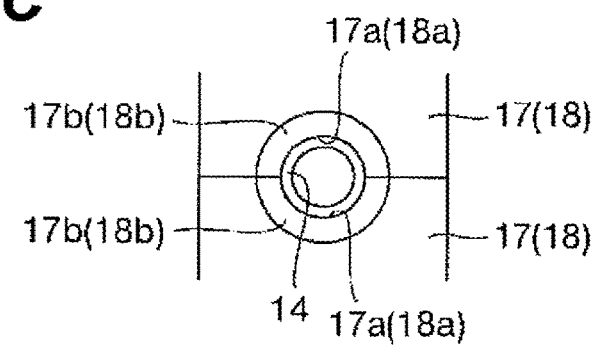

The lower mold 11 is fixed to a large base 15. Further, the lower mold 11 is configured of a large steel block and has a cavity (a concave portion) 16 in the upper surface thereof. In addition, electrode storage spaces 11*a* are provided in the vicinity of right and left ends (right and left ends in FIG. 1) of the lower mold 11, and a first electrode 17 and a second electrode 18 configured so as to be able to be advanced and retreated up and down by an actuator (not shown) are provided in the spaces 11*a*. Semicircular arc-shaped concave grooves 17*a* and 18*a* corresponding to the lower-side outer circumferential surface of the metal pipe material 14 are formed in the upper surfaces of the first and second electrodes 17 and 18 (refer to FIG. 5C), and the metal pipe material 14 can be placed so as to be exactly fitted to the portions of the concave grooves 17*a* and 18*a*. Further, tapered concave surfaces 17*b* and 18*b* recessed to be inclined in a tapered shape in circumference toward the concave grooves 17*a* and 18*a* are formed in the front faces (the faces in an outward direction of a mold) of the first and second electrodes 17 and 18. Further, a cooling water passage 19 is formed in the lower mold 11, and a thermocouple 21 inserted from below is provided approximately at the center of the lower mold 11. The thermocouple 21 is supported by a spring 22 so as to be able to move up and down.

Further, a pair of first and second electrodes 17 and 18 which is located on the lower mold 11 side also serves as the pipe holding mechanism 30 and can horizontally support the metal pipe material 14 such that the metal pipe material 14 can move up and down between the upper mold 12 and the lower mold 11. Further, the thermocouple 21 merely illustrates an example of temperature measuring means, and a non-contact type temperature sensor such as a radiation thermometer or an optical thermometer is also acceptable. In addition, if the correlation between an energization time and a temperature is obtained, it is also sufficiently possible to make a configuration with the temperature measuring means omitted.

The upper mold 12 is a large steel block having a cavity (a concave portion) 24 in the lower surface thereof and having a cooling water passage 25 built-in. The upper mold 12 is fixed to the slide 82 at an upper end portion thereof. Then, the slide 82 with the upper mold 12 fixed thereto is suspended from a pressurizing cylinder 26 and guided by a guide cylinder 27 so as not to laterally oscillate. The drive unit 81 according to this embodiment is provided with a servomotor 83 which generates a driving force for moving the slide 82. The drive unit 81 is configured by a fluid supply section which supplies a fluid that drives the pressurizing cylinder 26 (in a case where a hydraulic cylinder is adopted as the pressurizing cylinder 26, hydraulic oil) to the pressurizing cylinder 26. The control unit 70 controls the servomotor 83 of the drive unit 81, thereby controlling the amount of the fluid which is supplied to the pressurizing cylinder 26. In this way, it is possible to control the movement of the slide 82. In addition, the drive unit 81 is not limited to a configuration to apply a driving force to the slide 82 through the pressurizing cylinder 26, as described above, and may have, for example, a configuration to directly or indirectly apply a driving force that is generated by the servomotor 83 to the slide 82 by mechanically connecting a drive unit to the slide 82. Further, in this embodiment, only the upper mold 12 moves. However, a configuration is also acceptable in which in addition to the upper mold 12 or instead of the upper mold 12, the lower mold 11 moves. Further, in this embodiment, the drive unit 81 may not be provided with the servomotor 83.

Further, the first electrode 17 and the second electrode 18 configured so as to be able to be advanced and retreated up and down by an actuator (not shown) are provided in electrode storage spaces 12*a* provided in the vicinity of right and left ends (right and left ends in FIG. 1) of the upper mold 12, similar to the lower mold 11. The semicircular arc-shaped concave grooves 17*a* and 18*a* corresponding to the upper-side outer circumferential surface of the metal pipe material 14 are formed in the lower surfaces of the first and second electrodes 17 and 18 (refer to FIG. 5C), and the metal pipe material 14 can be exactly fitted to the concave grooves 17*a* and 18*a*. Further, the tapered concave surfaces 17*b* and 18*b* recessed to be inclined in a tapered shape in circumference toward the concave grooves 17*a* and 18*a* are formed in the front faces (the faces in the outward direction of the mold) of the first and second electrodes 17 and 18. That is, a configuration is made such that, if the metal pipe material 14 is gripped by the upper and lower pairs of first and second electrodes 17 and 18 from an up-and-down direction, the outer circumference of the metal pipe material 14 can be exactly surrounded in a close contact manner over the entire circumference.

Figure 2:
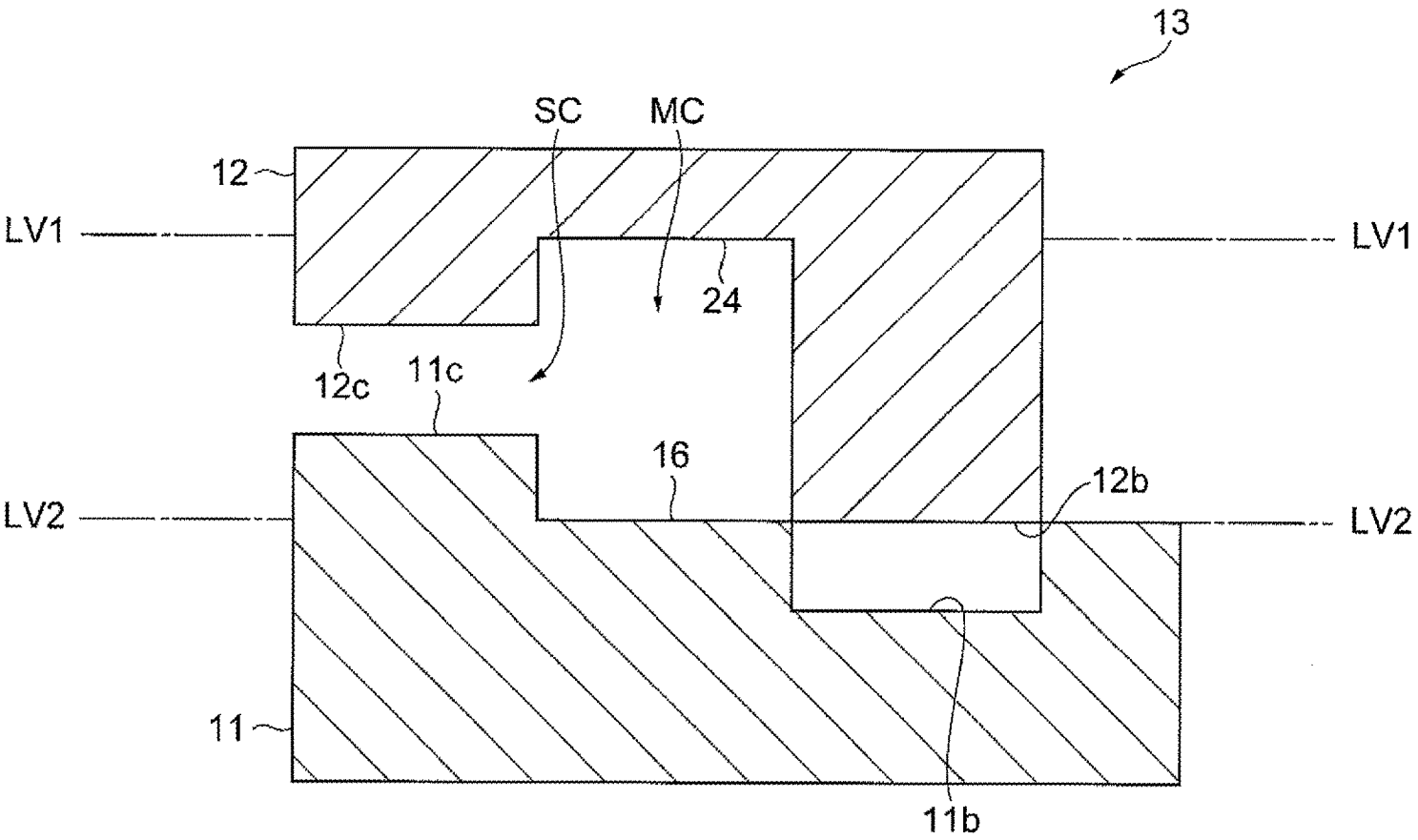
FIG. 2 is a cross-sectional view taken along line II-II shown in FIG. 1 and is a schematic cross-sectional view of a blow molding mold.

Next, a schematic cross-section when the blow molding mold 13 is viewed from a side direction is shown in FIG. 2. This is a cross-sectional view of the blow molding mold 13 taken along line II-II in FIG. 1 and viewed in a direction of an arrow and shows the state of a mold position at the time of blow molding. In a case where the blow molding mold 13 is viewed from the side, complicated steps are formed on each of the surfaces of the upper mold 12 and the lower mold 11.

If the surface of the cavity 24 of the upper mold 12 is set as a reference line LV1, a first projection 12*b* and a second projection 12*c* are formed on the surface of the upper mold 12. The first projection 12*b* that protrudes the most is formed on the right side (the right side in FIG. 2) of the cavity 24, and the second projection 12*c* is formed on the left side (the left side in FIG. 2) of the cavity 24. On the other hand, if the surface of the cavity 16 of the lower mold 11 is set as a reference line LV2, on the surface of the lower mold 11, a first recessed portion 11*b* is formed on the right side (the right side in FIG. 2) of the cavity 16 and a first projection 11*c* is formed on the left side (the left side in FIG. 2) of the cavity 16.

Further, the first projection 12*b* of the upper mold 12 is made to be able to be exactly fitted into the first recessed portion lib of the lower mold 11. Further, the second projection 12*c* of the upper mold 12 and the first projection 11*c* of the lower mold 11 are formed so as to be separated from each other in the up-and-down direction and be parallel to each other. As a result, as shown in FIG. 2, at a mold position at the time of blow molding, a configuration is made in which a main cavity portion (a first cavity portion) MC is formed between the surface (the surface which becomes the reference line LV1) of the cavity 24 of the upper mold 12 and the surface (the surface which becomes the reference line LV2) of the cavity 16 of the lower mold 11 and a sub-cavity portion (a second cavity portion) SC having small volume is formed next to the main cavity portion MC. The main cavity portion MC is a portion which molds a pipe portion 80*a* in the metal pipe 80, and the sub-cavity portion SC is a portion which molds a flange portion 80*b* in the metal pipe 80.

The heating mechanism 50 is configured to have a power supply 51, a conducting wire 52 which extends from the power supply 51 and is connected to the first electrode 17 and the second electrode 18, and a switch 53 interposed in the conducting wire 52.

The blowing mechanism 60 is composed of a high-pressure gas source 61, an accumulator 62 which stores high-pressure gas supplied from the high-pressure gas source 61, a first tube 63 which extends from the accumulator 62 to a cylinder unit 42, a pressure control valve 64 and a changeover valve 65 which are interposed in the first tube 63, a second tube 67 which extends from the accumulator 62 to a gas passage 46 formed in a seal member 44, and an ON-OFF valve 68 and a check valve 69 which are interposed in the second tube 67. Further, a leading end of the seal member 44 has a tapered surface 45 formed therein such that the leading end is tapered, and is configured in a shape capable of being exactly fitted to and brought into contact with the tapered concave surfaces 17*b* and 18*b* of the first and second electrodes (refer to FIGS. 5A to 5C). Further, the seal member 44 is connected to the cylinder unit 42 through a cylinder rod 43, thereby being made so as to be able to advance and retreat in accordance with an operation of the cylinder unit 42. Further, the cylinder unit 42 is placed on and fixed to the base 15 through a block 41.

The pressure control valve 64 plays a role to supply high-pressure gas having an operating pressure adapted to be a pushing force which is required from the seal member 44 side, to the cylinder unit 42. The check valve 69 plays a role to prevent the high-pressure gas from flowing back in the second tube 67. The control unit 70 obtains temperature information from the thermocouple 21 through transmission of information from (A) to (A) and controls the pressurizing cylinder 26, the switch 53, the changeover valve 65, the ON-OFF valve 68, and the like.

The water circulation mechanism 72 is composed of a water tank 73 which stores water, a water pump 74 which pumps up and pressurizes the water stored in the water tank 73 and sends the water to the cooling water passage 19 of the lower mold 11 and the cooling water passage 2 of the upper mold 12, and a pipe 75. Although it is omitted, a cooling tower which lowers a water temperature or a filter which purifies water may be interposed in the pipe 75.

<Operation of Molding Apparatus>

Figure 3A:
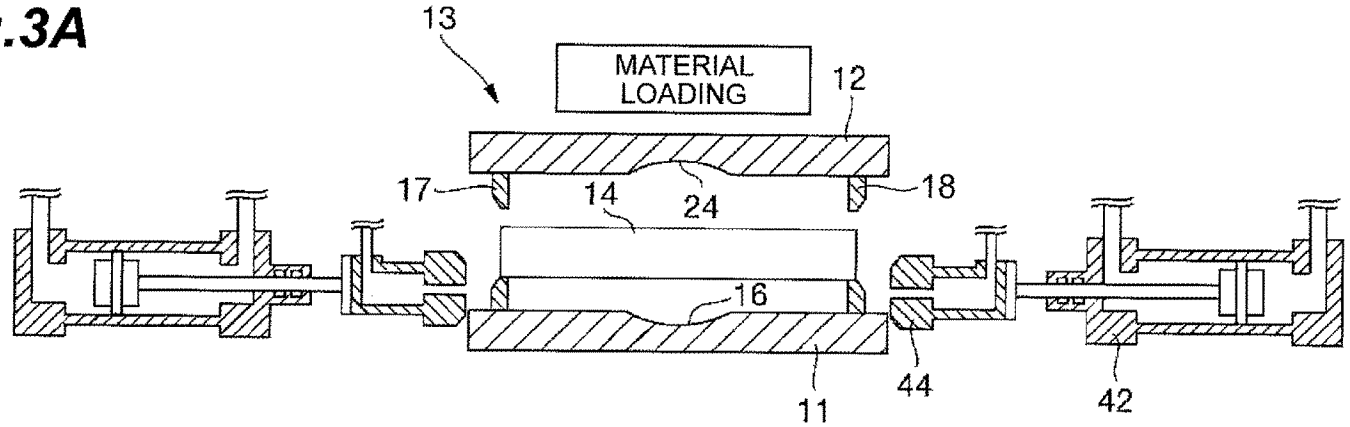
Figure 3B:
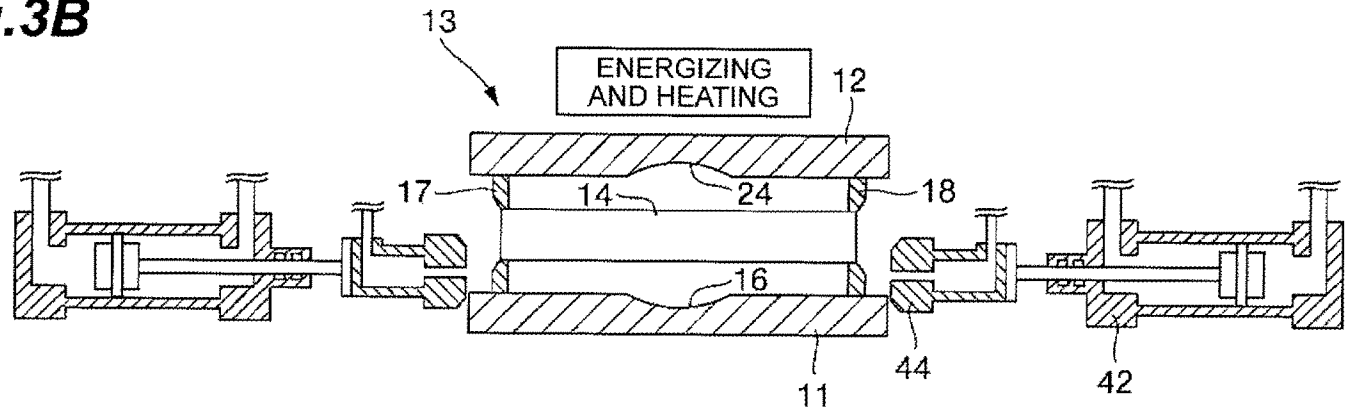

Next, an operation of the molding apparatus 10 will be described. FIGS. 3A and 3B show a manufacturing process from a pipe loading process of loading the metal pipe material 14 as a material to an energizing and heating process of energizing and heating the metal pipe material 14. As shown in FIG. 3A, the metal pipe material 14 having a steel grade capable of being quenched is prepared and the metal pipe material 14 is placed on the first and second electrodes 17 and 18 provided on the lower mold 11 side by using a robot arm (not shown) or the like. The concave grooves 17*a* and 18*a* are formed in the first and second electrodes 17 and 18, and therefore, the metal pipe material 14 is positioned by the concave grooves 17*a* and 18*a*. Next, the control unit 70 (refer to FIG. 1) controls the pipe holding mechanism 30 such that the pipe holding mechanism 30 holds the metal pipe material 14 by the pipe holding mechanism 30. Specifically, as in FIG. 3B, an actuator (not shown) capable of advancing and retreating the respective electrodes 17 and 18 is operated, thereby making the first and second electrodes 17 and 18 which are located on each of the upper and lower sides approach each other and come into contact with each other. Due to the operation of the actuator, both end portions of the metal pipe material 14 are gripped by the first and second electrodes 17 and 18 from above and below. Further, the metal pipe material 14 is gripped in a close contact aspect over the entire circumference thereof due to the existence of the concave grooves 17*a* and 18*a* formed in the first and second electrodes 17 and 18 which come into contact with each other. However, there is no limitation to the configuration in which close contact is performed over the entire circumference of the metal pipe material 14, and a configuration is also acceptable in which the first and second electrodes 17 and 18 come into contact with a portion in a circumferential direction of the metal pipe material 14.

Subsequently, the control unit 70 controls the heating mechanism 50 such that the heating mechanism 50 heats the metal pipe material 14. Specifically, the control unit 70 switches on the switch 53 of the heating mechanism 50. Then, electric power is supplied from the power supply 51 to the metal pipe material 14 and the metal pipe material 14 itself generates heat (Joule heat) due to resistance which is present in the metal pipe material 14. In this case, the measurement value of the thermocouple 21 is continuously monitored and energization is controlled based on the result.

Figure 4:
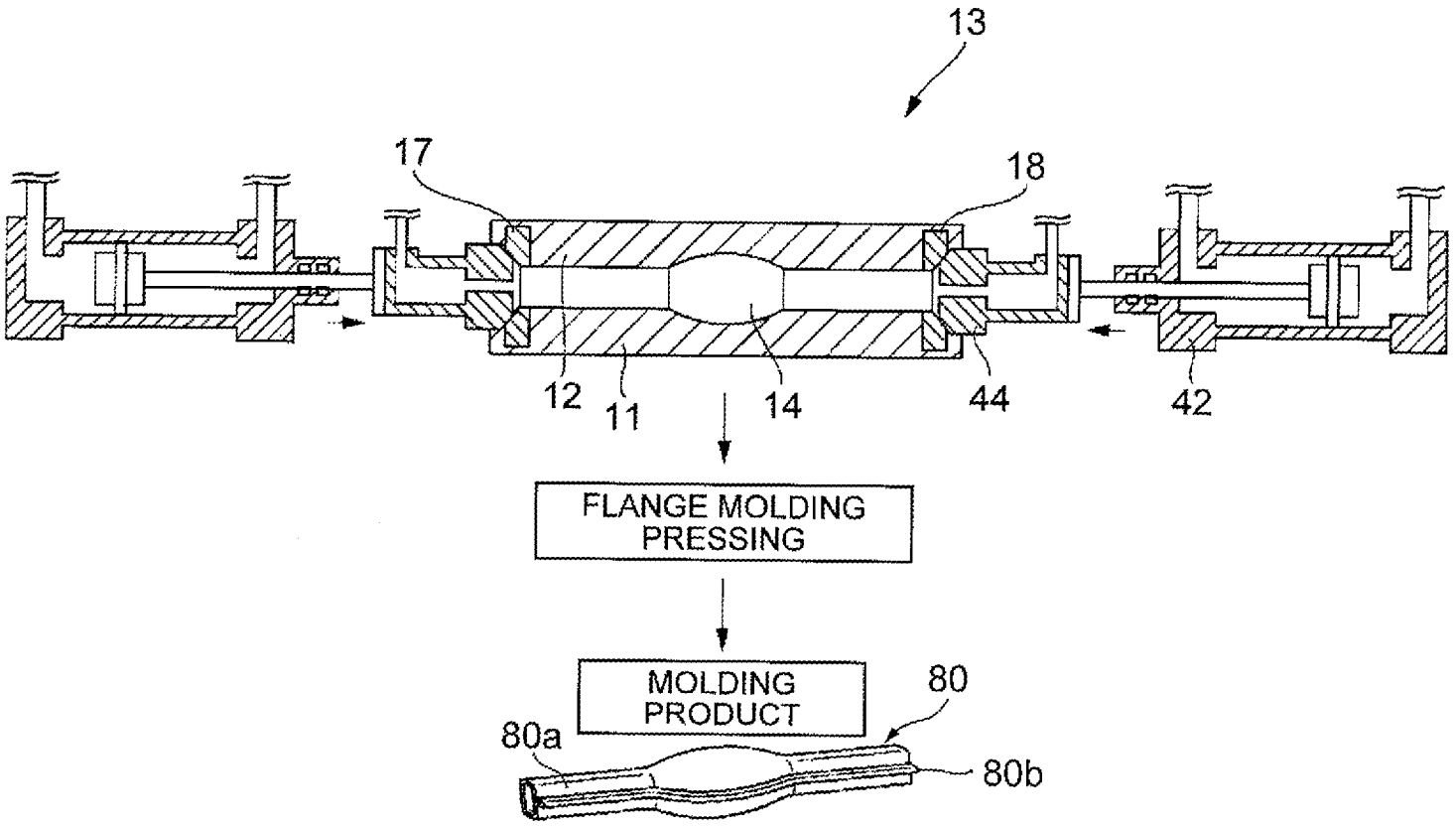
FIG. 4 is a diagram showing a blow molding process of the molding apparatus and a subsequent flow.

FIG. 4 shows a flow in which the metal pipe 80 with a flange, in which the flange portion 80*b* is formed on the pipe portion 80*a*, is obtained as a finished product by molding a flange by pressing on the metal pipe material 14 after the blow molding. The control unit 70 controls the blowing mechanism 60 such that the blowing mechanism 60 supplies gas into the metal pipe material 14 held between the upper mold 12 and the lower mold 11 by the pipe holding mechanism 30, thereby expanding and molding the metal pipe material 14. Further, the control unit 70 controls the drive unit 81 such that the drive unit 81 crushes a portion of the expanded and molded metal pipe material 14 in the sub-cavity portion SC between the upper mold 12 and the lower mold 11, thereby molding the flange portion 80*b*. Specifically, as shown in FIG. 4, the blow molding mold 13 is closed with respect to the metal pipe material 14 after heating, and thus the metal pipe material 14 is disposed and hermetically sealed in the cavity of the blow molding mold 13. Thereafter, the cylinder unit 42 is operated, whereby each of both ends of the metal pipe material 14 is sealed by the seal member 44 that is a portion of the blowing mechanism 60 (refer to FIGS. 5A to 5C together). In addition, the sealing is indirectly performed through the tapered concave surfaces 17*b* and 18*b* formed in the first and second electrodes 17 and 18, rather than being performed by direct contact of the seal members 44 with both end surfaces of the metal pipe material 14. By doing so, sealing can be performed at a wide area, and therefore, seal performance can be improved, and in addition, wear of the seal member due to a repeated sealing operation is prevented and collapse or the like of both end surfaces of the metal pipe material 14 is effectively prevented. After the completion of the sealing, high-pressure gas is blown into the metal pipe material 14, whereby the metal pipe material 14 softened due to heating is deformed so as to conform to the shape of the cavity. Thereafter, a pressing operation for forming the flange portion 80*b* is performed on the metal pipe material 14 after the blow molding (in this regard, the details will be separately described later), and then, if mold opening is performed, as shown in FIG. 4, the metal pipe 80 having the pipe portion 80*a* and the flange portion 80*b*, as a finished product, is completed.

The metal pipe material 14 is softened by being heated to a high temperature (around 950° C.), and thus can be blow-molded with relatively low pressure. Specifically, in a case where compressed air having a pressure of 4 MPa at normal temperature (25° C.) is adopted as the high-pressure gas, as a result, the compressed air is heated to around 950° C. in the hermetically-sealed metal pipe material 14. The compressed air thermally expands and reaches a pressure in a range of about 16 MPa to 17 MPa, based on the Boyle-Charles' Law. That is, it is possible to easily blow-mold the metal pipe material 14 of 950° C.

Then, the outer circumferential surface of the blow-molded and swelled metal pipe material 14 is rapidly cooled in contact with the cavity 16 of the lower mold 11 and at the same time, is rapidly cooled in contact with the cavity 24 of the upper mold 12 (since the upper mold 12 and the lower mold 11 have large heat capacities and are managed to have a low temperature, if the metal pipe material 14 comes into contact therewith, the heat of the surface of the pipe is removed to the mold side at once), whereby quenching is performed. Such a cooling method is called mold contact cooling or mold cooling. Immediately after the metal pipe material 14 is rapidly cooled, austenite is transformed into martensite. Since a cooling rate is reduced in the second half of the cooling, the martensite is transformed into another structure (troostite, sorbite, or the like) due to reheating. Therefore, it is not necessary to separately perform tempering treatment.

Figure 6A:
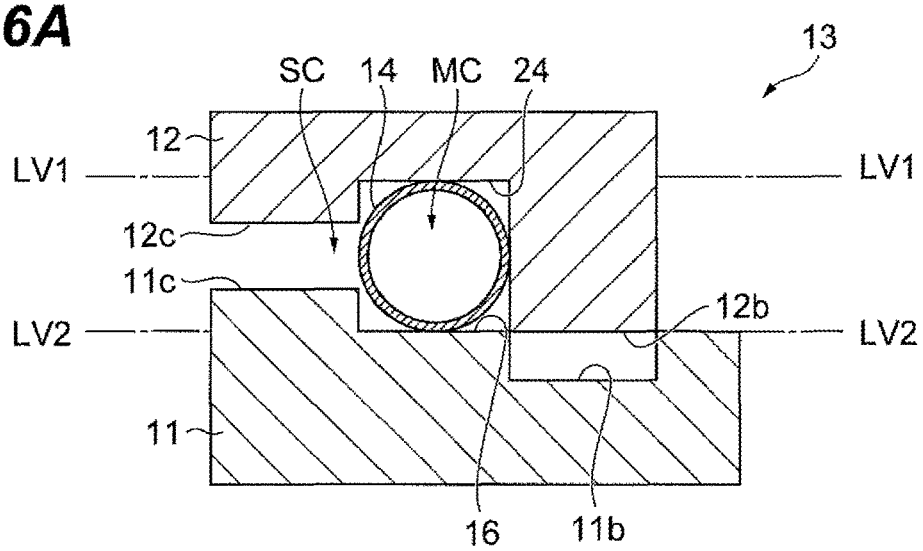
Figure 6B:
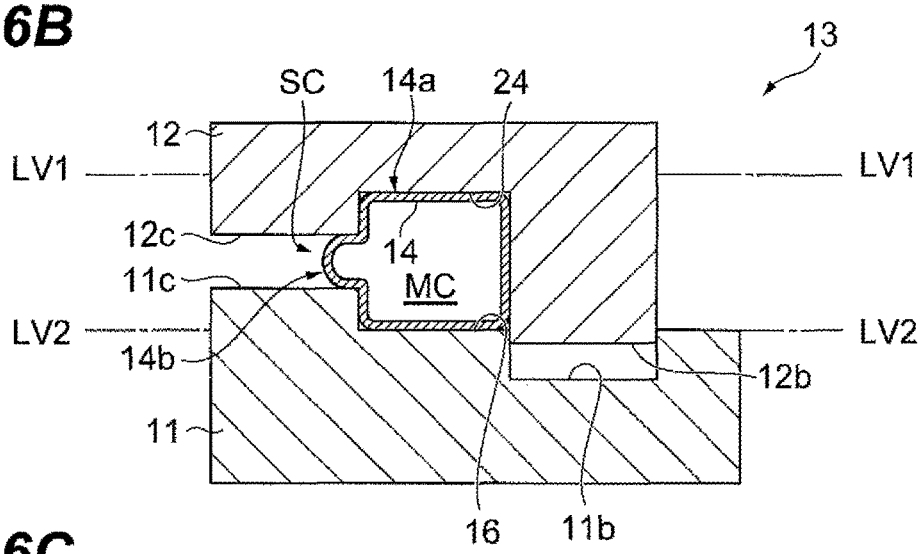

Next, the state of the molding by the upper mold 12 and the lower mold 11 will be described in detail with reference to FIGS. 6A to 6C. In addition, in the following description, a portion corresponding to the pipe portion 80*a* of the metal pipe 80 related to a finished product, of the metal pipe material 14 which is being molded, is referred to as a "first molded portion 14*a*", and a portion corresponding to the flange portion 80*b* is referred to as a "second molded portion 14*b*". As shown in FIGS. 6A and 6B, in the molding apparatus 10 according to this embodiment, the blow molding is not performed in a state where the upper mold 12 and the lower mold 11 are completely closed (clamped). That is, the blow molding is performed in a state where a constant separation state is maintained between the upper mold 12 and the lower mold 11, whereby the sub-cavity portion SC is formed next to the main cavity portion MC. In this state, the main cavity portion MC is formed between the surface on the reference line LV1 of the cavity 24 and the surface on the reference line LV2 of the cavity 16. Further, the sub-cavity portion SC is formed between the surface of the second projection 12*c* of the upper mold 12 and the surface of the first projection 11*c* of the lower mold 11. The main cavity portion MC and the sub-cavity portion SC are in a state of communicating with each other. Further, in this embodiment, the surface of the second projection 12*c* of the upper mold 12 and the surface of the first projection 11*c* of the lower mold 11, which configure the sub-cavity portion SC, extend to end portions in a width direction (in FIGS. 6A to 6C, on the left side) of the upper mold 12 and the lower mold 11 in a state of being separated from each other in the up-and-down direction. Therefore, the sub-cavity portion SC communicates with the outside of the mold. As a result, as shown in FIG. 6B, the metal pipe material 14 which is softened due to heating and in which high-pressure gas is injected enters not only the main cavity portion MC, but also the portion of the sub-cavity portion SC and expands therein. In the example shown in FIGS. 6A to 6C, since the main cavity portion MC is configured as a rectangular cross-sectional shape, the metal pipe material 14 is blow-molded in accordance with the shape, thereby being molded into a rectangular cross-sectional shape. In addition, the portion corresponds to the first molded portion 14*a* which becomes the pipe portion 80*a*. However, the shape of the main cavity portion MC is not particularly limited and any shape such as a circular shape, an elliptical shape, or a polygonal shape may be adopted in accordance with a desired shape. Further, since the main cavity portion MC and the sub-cavity portion SC communicate with each other, a portion of the metal pipe material 14 enters the sub-cavity portion SC. The portion corresponds to the second molded portion 14*b* which is crushed, thereby becoming the flange portion 80*b*.

Figure 6C:
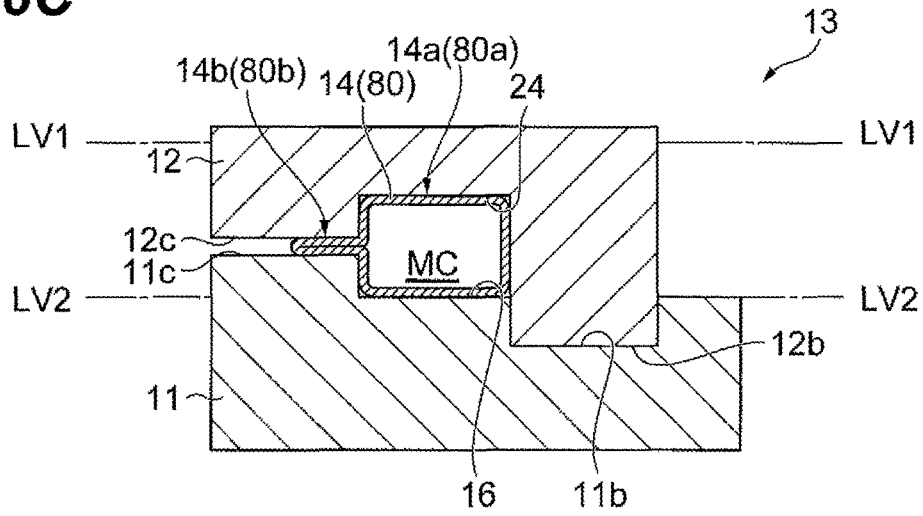

As shown in FIG. 6C, after the blow molding or at a stage during the course of the blow molding, the upper mold 12 and the lower mold 11 which are separated from each other are made to approach each other. Due to this operation, the volume of the sub-cavity portion SC is reduced, and thus the internal space of the second molded portion 14*b* disappears and the second molded portion 14*b* enters a folded state. That is, due to the approach of the upper mold 12 and the lower mold 11, the second molded portion 14*b* of the metal pipe material 14 which has entered the sub-cavity portion SC is pressed and crushed. As a result, the second molded portion 14*b* crushed so as to follow a longitudinal direction of the metal pipe material 14 (in this state, the metal pipe material 14 has the same shape as that of the metal pipe 80 as a finished product) is molded on the outer circumferential surface of the metal pipe material 14. Further, the time from the blow molding to the completion of the press molding of the flange portion 80*b* also depends on the type of the metal pipe material 14. However, it is completed approximately in a range of 1 second to 2 seconds. Further, in the example shown in FIGS. 6A to 6C, the surface of the first projection 12*b* of the upper mold 12 comes into contact with the bottom surface of the first recessed portion lib of the lower mold 11, and thus a state is created where the upper mold 12 and the lower mold 11 cannot come close to each other anymore. In this state, a gap corresponding to the thickness of the crushed second molded portion 14*b* (that is, the flange portion 80*b*) is formed between the surface of the second projection 12*c* of the upper mold 12 and the surface of the first projection 11*c* of the lower mold 11, which configure the sub-cavity portion SC. Also in this state, the sub-cavity portion SC is in a state of communicating with the outside of the mold. That is, in the example shown in FIGS. 6A to 6C, the sub-cavity portion SC communicates with the outside of the mold from the start of molding to the completion of molding at the time of the molding of the flange portion 80*b* of the metal pipe 80 (the second molded portion 14*b* of the metal pipe material 14).

Further, due to the approach of the upper mold 12 and the lower mold 11 after the blow molding, not only the second molded portion 14*b* of the metal pipe material 14 which has entered the sub-cavity portion SC, but also the first molded portion 14*a* of the metal pipe material 14 in the portion of the main cavity portion MC is crushed. In this case, since the metal pipe material 14 has been heated and softened, finishing to a product without a slack or a twist can be performed by adjusting a mold closing speed, compressed gas, or the like.

Next, the operation and effects of the molding apparatus 10 according to this embodiment will be described.

Figure 9A:
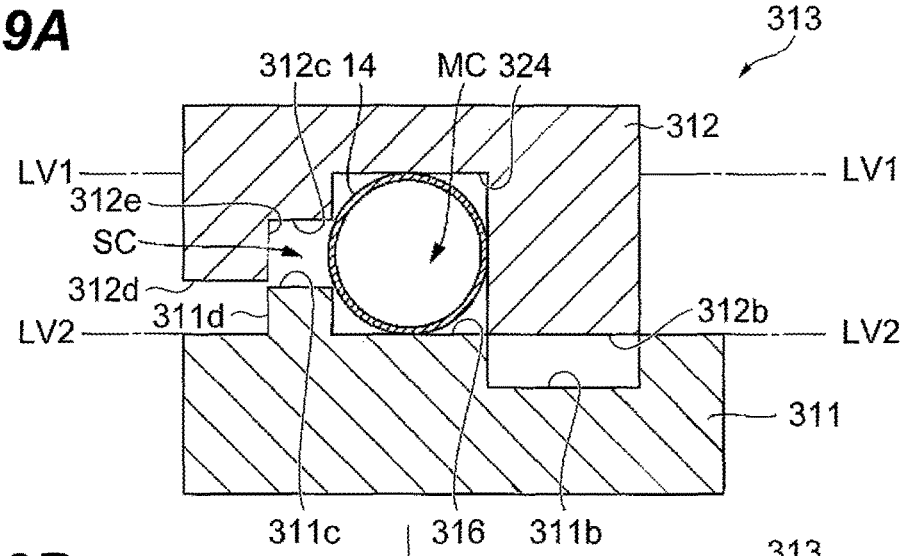
Figure 9B:
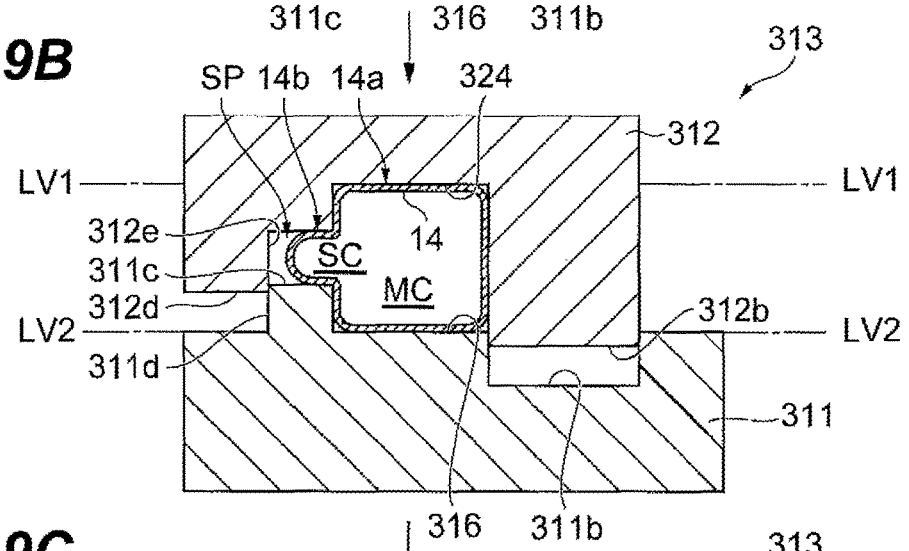
Figure 9C:
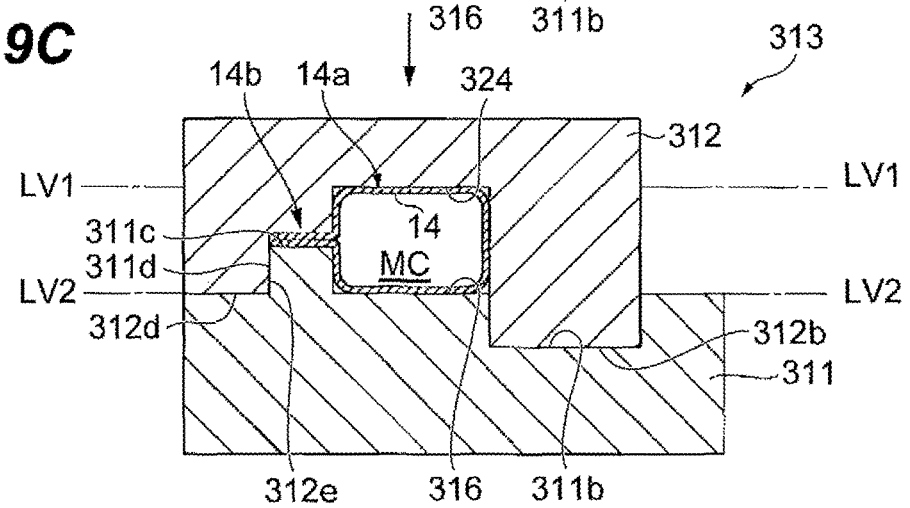

First, a blow molding mold 313 of a molding apparatus according to a comparative example will be described with reference to FIGS. 9A to 9C. In the blow molding mold 313 according to the comparative example, if the surface of a cavity 324 of an upper mold 312 is set as the reference line LV1, a first projection 312*b*, a second projection 312*c*, and a third projection 312*d* are formed on the surface of the upper mold 312. The first projection 312*b* that protrudes the most is formed on the right side (the right side in FIGS. 9A to 9C) of the cavity 324, and the second projection 312*c* and the third projection 312*d* are formed in a staircase pattern on the left side (the left side in FIGS. 9A to 9C) of the cavity 324. On the other hand, if the surface of a cavity 316 of a lower mold 311 is set as the reference line LV2, on the surface of the lower mold 311, a first recessed portion 311*b* is formed on the right side (the right side in FIGS. 9A to 9C) of the cavity 316 and a first projection 311*c* is formed on the left side (the left side in FIGS. 9A to 9C) of the cavity 316. Further, the first projection 312*b* of the upper mold 312 is made to be able to be exactly fitted into the first recessed portion 311*b* of the lower mold 311. Further, the first projection 311*c* of the lower mold 311 is made to be able to be fitted to a step portion between the second projection 312*c* and the third projection 312*d* of the upper mold 312. As a result of being configured in this manner, as shown in FIGS. 9A to 9C, at a mold position at the time of the blow molding, a configuration is made in which the sub-cavity portion SC having small volume is formed next to the main cavity portion MC.

In the blow molding mold 313 according to the comparative example, the third projection 312*d* of the upper mold 312 is formed on the sub-cavity portion SC side, and the first projection 311*c* of the lower mold 311 is made to be able to be fitted to the step portion between the second projection 312*c* and the third projection 312*d*. When the step portion and the first projection 311*c* are fitted to each other, a state is created where a side surface 312*e* of the third projection 312*d* of the upper mold 312 and a side surface 311*d* of the first projection 311*c* of the lower mold 311 are in contact with each other. Therefore, as shown in FIGS. 9B and 9C, at the time of pressing to crush the metal pipe material 14, the sub-cavity portion SC is cut off from the outside of the mold by the projections 312*c*, 312*d*, and 311*c*, whereby the main cavity portion MC and the sub-cavity portion SC enter a closed state. In this case, when expanding and molding the metal pipe material 14, a state is created where air which is present in a space SP (refer to FIG. 9B) outside the metal pipe material 14, of the sub-cavity portion SC, is sandwiched between the surfaces of the projections 312*c*, 312*d*, and 311*c* and the outer surface of the second molded portion 14*b* of the metal pipe material 14 which expands. Such air becomes bubbles, and thus there is a possibility that moldability may be affected.

On the other hand, in the molding apparatus 10 according to this embodiment, the control unit 70 controls the blowing mechanism 60 such that the blowing mechanism 60 expands and molds the metal pipe material 14 by supplying gas into the metal pipe material 14 held between the upper mold 12 and the lower mold. 11 by the pipe holding mechanism 30. In this way, a portion (that is, the first molded portion 14*a*) corresponding to the pipe portion 80*a* of a finished product, of the metal pipe material 14, is expanded and molded into a shape corresponding to the main cavity portion MC, and a portion (that is, the second molded portion 14*b*) corresponding to the flange portion 80*b* of the finished product expands toward the sub-cavity portion SC. Further, the control unit 70 controls the drive unit 81 such that the drive unit 81 molds the flange portion 80*b* by crushing the second molded portion 14*b* of the expanded metal pipe material 14 in the sub-cavity portion SC between the upper mold 12 and the lower mold 11. Here, the sub-cavity portion SC communicates with the outside of the mold during the molding of the flange portion 80*b*. Therefore, during the molding of the flange portion 80*b*, air between the inner surface of the sub-cavity portion SC and the second molded portion 14*b* of the metal pipe material 14 can escapes to the outside of the mold. In this way, it is possible to prevent the occurrence of wrinkles, or the like, and thus the quality of a molding product can be improved. Further, in a case of making the sub-cavity portion SC communicate with the outside of the mold, the surface of the second projection 12*c* of the upper mold 12 and the surface of the first projection 11*c* of the lower mold 11, which are locations corresponding to the sub-cavity portion SC, can be formed straight toward the outside of the mold and parallel to each other, and therefore, it is possible to make the shape of the mold simple, as compared to the upper mold 312 and the lower mold 311 shown in FIGS. 9A to 9C, and thus it is possible to reduce the manufacturing cost of the mold.

Further, in the molding apparatus 10 according to this embodiment, the sub-cavity portion SC communicates with the outside of the mold from the start of molding to the completion of molding. In this way, air in the sub-cavity portion SC can escape to the outside of the mold from the start of molding to the completion of molding, and therefore, the quality of a molding product can be improved.

The present invention is not limited to the embodiment described above.

Figure 7A:
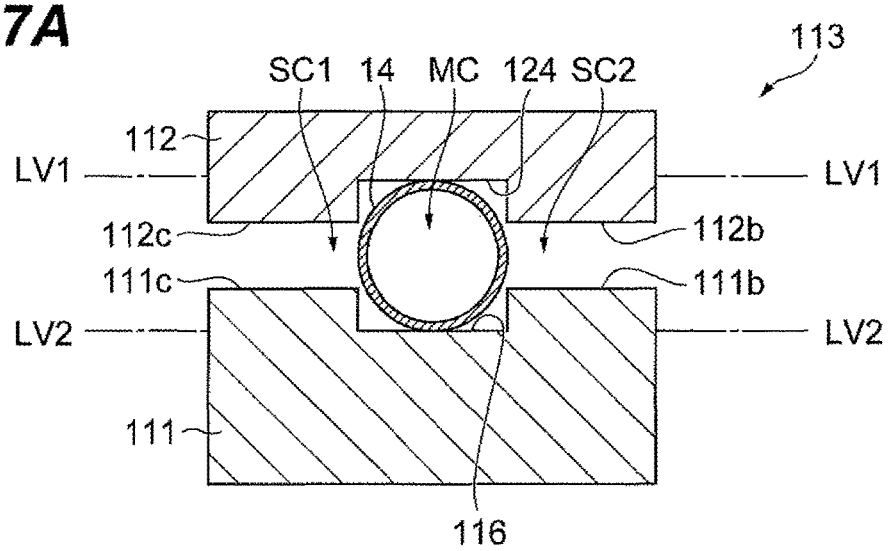
Figure 7B:
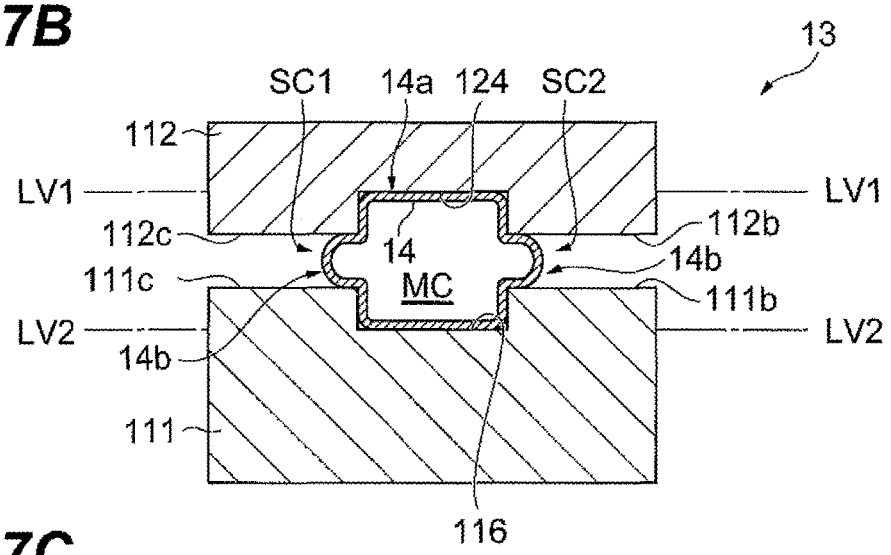
Figure 7C:
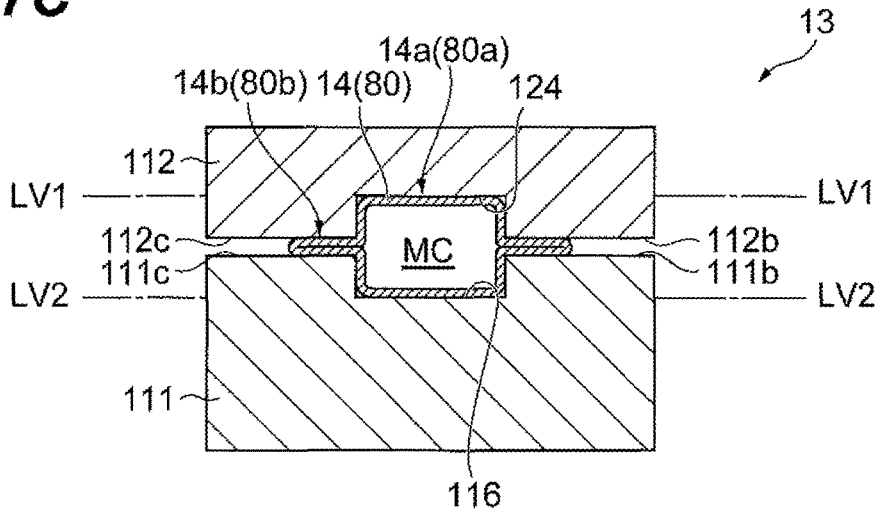

For example, a blow molding mold 113 according to a configuration as shown in FIGS. 7A to 7C may be adopted. Specifically, the blow molding mold 113 has, on one side of the main cavity portion MC, a sub-cavity portion SC1 which is formed between the surface of a projection 112*c* of an upper mold 112 and the surface of a projection 111*c* of a lower mold 111, and has, on the other side of the main cavity portion MC, a sub-cavity portion SC2 which is formed between the surface of a projection 112*b* of the upper mold 112 and the surface of a projection 111*b* of the lower mold 111. In this way, the blow molding mold 113 can mold the flange portions 80*b* on both sides of the pipe portion 80*a* of the metal pipe 80. Further, both the sub-cavity portion SC1 and the sub-cavity portion SC2 communicate with the outside of the mold from the start of molding to the completion of molding. However, it is favorable if at least one of the sub-cavity portion SC1 and the sub-cavity portion SC2 communicates with the outside of the mold.

Figure 8A:
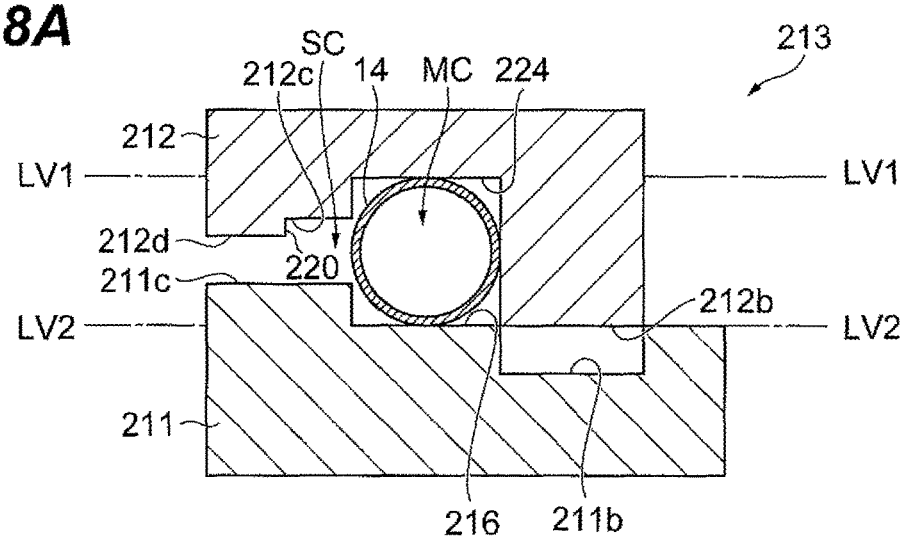
Figure 8B:
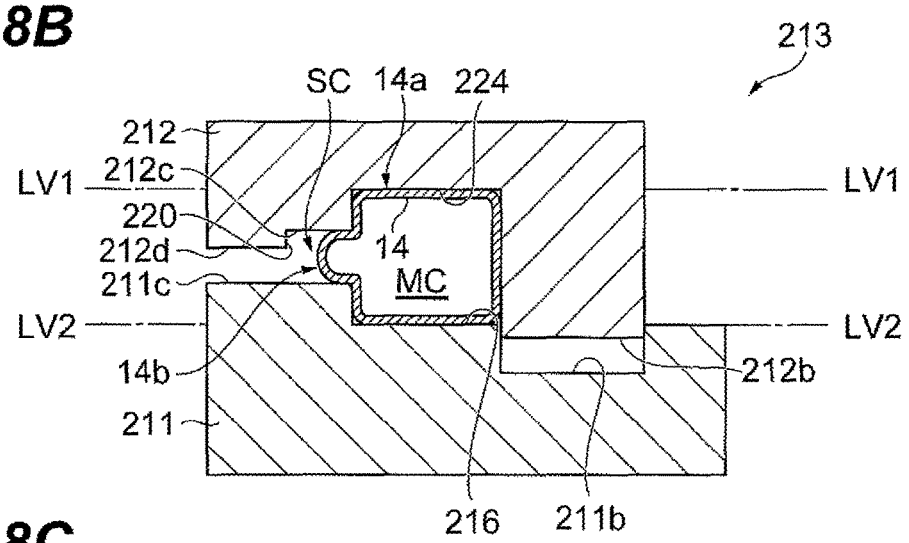
Figure 8C:
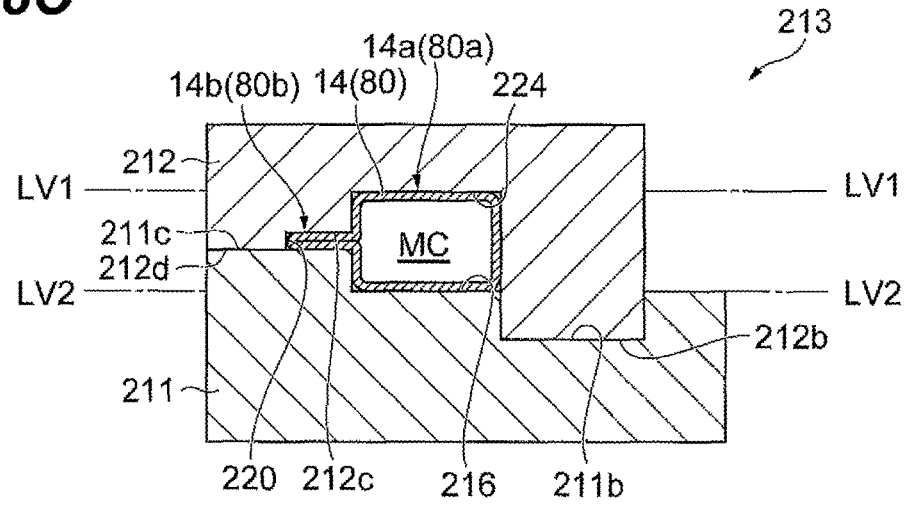

Further, for example, a blow molding mold 213 according to a configuration as shown in FIGS. 8A to 8C may be adopted. In the blow molding mold 213, a step 220 having a size corresponding to the flange portion 80*b* is formed at an upper mold 212 in the sub-cavity portion SC. Specifically, the step 220 is formed by further providing a projection 212*d* on the surface of a projection 212*c* of the upper mold 212. In this way, as shown in FIG. 8, when crushing the second molded portion 14*b* of the metal pipe material 14, the sub-cavity portion SC can communicate with the outside of the mold, and on the other hand, as shown in FIG. 8C, at the point in time when the sub-cavity portion SC has molded the flange portion 80*b*, crushing of the flange portion 80*b* by the sub-cavity portion SC is restricted by the step 220 having a size corresponding to the thickness of the flange portion 80*b*. Therefore, the flange portion 80*b* can be prevented from being crushed more than necessary. Further, in a state where the surface of the projection 212*d* is in contact with the surface of a projection 211*c*, the sub-cavity portion SC is cut off from the outside of the mold. However, since it is after the flange portion 80*b* has been already molded by crushing the second molded portion 14*b*, wrinkles or the like does not occur in the flange portion 80*b*. Further, in the example shown in FIGS. 8A to 8C, the step is formed on the upper mold 212 side. However, the step 220 may be formed at a lower mold 211. Alternatively, a configuration is also acceptable in which steps are formed at both the upper mold 212 and the lower mold 211 and the sum of both the steps has a size corresponding to the thickness of the flange portion 80*b*.

Further, in the molding apparatus 10 described above, the heating mechanism 50 capable of performing heating treatment between the upper and lower molds is provided and the metal pipe material 14 is heated by using Joule heat by energization. However, there is no limitation thereto. For example, a configuration is also acceptable in which heating treatment is performed at a place other than the place between the upper and lower molds and a metallic pipe after the heating is transported into an area between the molds. Further, in addition to the use of Joule heat by energization, radiation heat of a heater or the like may be used, and it is also possible to perform heating by using a high-frequency induction current.

As the high-pressure gas, a non-oxidizing gas or an inert gas such as nitrogen gas or argon gas can be adopted mainly. Although these gases can make generation of an oxidized scale in a metal pipe difficult, these gases are expensive. In this regard, in the case of compressed air, as long as a major problem due to the generation of an oxidized scale is not caused, it is inexpensive, and even if it leaks into the atmosphere, there is no actual harm, and handling is very easy. Therefore, it is possible to smoothly carry out a blowing process.

The blow molding mold may be either of a non-water-cooled mold or a water-cooled mold. However, the non-water-cooled mold needs a long time when reducing the temperature of the mold to a temperature near an ordinary temperature after the end of blow molding. In this regard, in the case of the water-cooled mold, cooling is completed in a short time. Therefore, from the viewpoint of improvement in productivity, the water-cooled mold is preferable.

According to the present invention, a molding apparatus capable of improving the quality of a molding product can be provided.

It should be understood that the invention is not limited to the above-described embodiment, but may be modified into various forms on the basis of the spirit of the invention. Additionally, the modifications are included in the scope of the invention.

What is claimed is:

1. A molding apparatus that molds a metal pipe with a flange, comprising:

a first mold and a second mold that are paired with each other;

a slide that moves at least one of the first mold and the second mold;

a drive unit that generates a driving force for moving the slide;

a holding section that holds a metal pipe material between the first mold and the second mold;

a gas supply section that supplies gas into the metal pipe material held by the holding section; and a control unit that controls the drive unit, the holding section, and the gas supply section, wherein the first mold and the second mold are provided with a first cavity portion that molds a pipe portion of the metal pipe, and a second cavity portion that molds a flange portion, wherein the control unit controls the gas supply section such that the gas supply section expands and molds the metal pipe material by supplying gas into the metal pipe material held between the first mold and the second mold by the holding section and controls the drive unit such that the drive unit molds the flange portion by crushing a portion of the expanded metal pipe material in the second cavity portion of the first mold and the second mold, and wherein the second cavity portion communicates with an outside of the molds from the start of molding of the flange portion to the completion of the molding of the flange portion, so that at least some air between an inner surface of the second cavity portion and a place forming the flange portion of the metal pipe escapes to the outside of the molds.

2. A molding apparatus that molds a metal pipe with a flange, comprising:

a first mold and a second mold that are paired with each other;

a slide that moves at least one of the first mold and the second mold;

a drive unit that generates a driving force for moving the slide;

a holding section that holds a metal pipe material between the first mold and the second mold;

a gas supply section that supplies gas into the metal pipe material held by the holding section; and a control unit that controls the drive unit, the holding section, and the gas supply section, wherein the first mold and the second mold are provided with a first cavity portion that molds a pipe portion of the metal pipe, and a second cavity portion that molds a flange portion, wherein the control unit controls the gas supply section such that the gas supply section expands and molds the metal pipe material by supplying gas into the metal pipe material held between the first mold and the second mold by the holding section and controls the drive unit such that the drive unit molds the flange portion by crushing a portion of the expanded metal pipe material in the second cavity portion of the first mold and the second mold, and wherein the second cavity portion communicates with an outside of the molds from a start of molding so that at least some air between an inner surface of the second cavity portion and a place forming the flange portion of the metal pipe escapes to the outside of the molds, and wherein the second cavity includes a step having a size corresponding to a thickness of the flange portion which closes communication of the second cavity to the outside of the molds and prevents excess crushing of the flange portion at a closed position of the molds that completes the molding.

* * * * *